US010455870B2

(12) United States Patent
Wood

(10) Patent No.: US 10,455,870 B2
(45) Date of Patent: Oct. 29, 2019

(54) PROTECTIVE ARTICLES

(71) Applicant: Stealthwear Protective Clothing Inc., Toronto (CA)

(72) Inventor: Aaron Wood, Toronto (CA)

(73) Assignee: STEALTHWEAR PROTECTIVE CLOTHING INC., Toronto, Ontario (CA)

( * ) Notice: Subject to any disclaimer, the term of this patent is extended or adjusted under 35 U.S.C. 154(b) by 171 days.

(21) Appl. No.: 14/669,767

(22) Filed: Mar. 26, 2015

(65) Prior Publication Data

US 2015/0272238 A1 Oct. 1, 2015

Related U.S. Application Data

(60) Provisional application No. 61/970,645, filed on Mar. 26, 2014.

(51) Int. Cl.
*A41D 13/08* (2006.01)

(52) U.S. Cl.
CPC ..... *A41D 13/08* (2013.01)

(58) Field of Classification Search
CPC ..... A41D 13/08
See application file for complete search history.

(56) References Cited

U.S. PATENT DOCUMENTS 3,585,639 A * 6/1971 Enicks ..... A41D 13/0568 128/892
4,485,491 A * 12/1984 Rasmussen ..... F41H 1/02 2/2.5
4,608,716 A * 9/1986 Brumfield ..... A41D 13/015 2/102
6,374,408 B1 * 4/2002 Tomlinson ..... A41D 13/0568 2/16

* cited by examiner

*Primary Examiner* — Richale L Quinn
(74) *Attorney, Agent, or Firm* — Dickinson Wright LLP

(57) ABSTRACT

Articles of clothing suitable for protecting against certain injury risks, such as impacts and abrasions, while simultaneously preserving an outward appearance of non-protective clothing, are provided. Such articles may include a forearm protector that is worn directly on the user's arm and a customizable, long-sleeved protective garment that may be worn by itself or in combination. Such forearm protectors and protective garments each incorporate one or more composite panels that cover parts of the body that may be susceptible to injury. The protective garment may include one or more removable panels to provide customizable protection to different parts of the user's torso and upper body, while the forearm protector, if worn, will protect parts of the user's arms. Depending on the type and degree of coverage sought, the protective articles may be worn either by themselves or as a cooperative pair within a combined protective system.

16 Claims, 7 Drawing Sheets

PROTECTIVE ARTICLES

CROSS-REFERENCE TO RELATED APPLICATIONS

This application claims the benefit of U.S. Provisional Application No. 61/970,645, filed Mar. 26, 2014, the entire contents of which are incorporated herein by reference.

TECHNICAL FIELD

The disclosure relates generally to protective articles and, more specifically, to articles of clothing that can protect wearers against at least some of the injury or other damage caused by various types of impacts or abrasions, while also retaining the appearance of or at least some resemblance to non-protective clothing.

BACKGROUND

There exist many different situations in which protective garments or other forms of clothing may be of use to a wearer. For example, such situations may arise where a person is likely to be exposed—in some cases, repeatedly—to various different known types of harm or danger. To protect against the risks associated with such harms or dangers, the person likely to be exposed may elect to wear suitable safety equipment. While such safety equipment may not be guaranteed to fully protect against the potential risk of harm, the user may at least generally expect a reduction of at least some of the associated risks.

Depending on the nature of the potential risk(s), appropriate safety equipment may take on different forms, be worn on different parts of the body, and be designed to protect against different sorts of possible harms caused. For example, helmets, masks and the like may be worn to protect against injuries to the head and/or face. Likewise protective boots and gloves may be worn to protect against injuries to feet and hands, respectively. As another example, force-resistant padding is often worn around the torso in order to protect again injuries to vital organs. It is also possible to wear abrasion-resistant padding in order to protect against surface wounds, such as cuts, gashes or punctures. Doubtless other types of protection can also be worn.

BRIEF DESCRIPTION OF THE DRAWINGS

To describe various different embodiments of an invention or multiple inventions, including at least one preferred embodiment thereof, reference will be made herein throughout to the accompanying drawings, in which.

For clarity and ease of description, like reference numerals will be used in the drawings to describe the same or like parts.

DETAILED DESCRIPTION

Figure 1A:
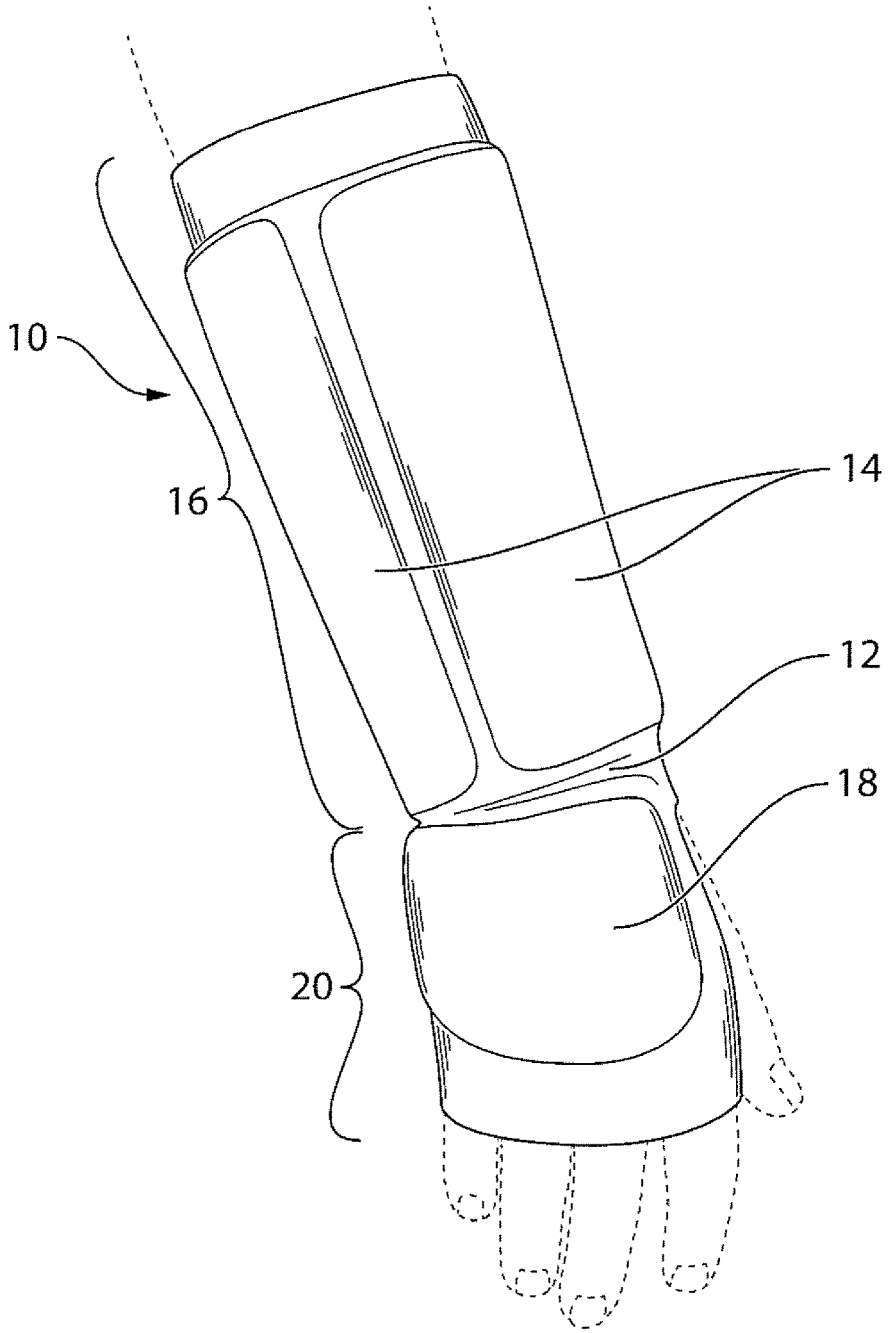
FIG. 1A shows a view of an embodiment of a forearm protector being worn by a user.

In some further situations, it may be also appropriate or otherwise convenient or necessary for protective clothing to also assume one or more different aesthetic qualities. For example, it may be the case that the clothing, while providing an adequate measure of protection to the wearer, may also constitute the outermost layer of clothing that is being worn by the person. Such articles of protective clothing, which will be visible to observers, may therefore also take on, or be designed so as to have, an outward appearance that elicits a certain response in those observers. This could be advantageous for a number of different reasons depending on the context in which the protective clothing is worn. In some cases, the protective clothing may be incorporated as part of a more elaborate dress or uniform; in other cases, it may be so that the protective clothing should not seem intimidating or perhaps even visible to observers.

One situation in which protective clothing having additional aesthetic quality(ies) may be worn relates to care provision for certain classes of people. For example, some medical and/or developmental conditions, including but not limited to autism, may predispose a person toward uncontrollable outbursts of anger or violence that can place care providers into the risk of harm. Protective clothing may therefore protect the care provider against common types of attack or other aggressive behaviors, like bites, hits, scratches, and pinches.

While autism or other neurodevelopmental spectrum disorders may represent one class of people whose care providers may elect to wear protective clothing, it is a non-limiting example of where protective clothing may be utilized. People who have developed certain age related disorders, such as Alzheimer's, dementia, or other cognitive impairment, may also be prone to uncontrollable outbursts of physical violence. Caregivers for this class of people may therefore also benefit from the use of protective clothing. This example too is non-limiting.

At the same time, protective clothing having an outward appearance that is very visible and/or discernible to a person with a medical or developmental condition, or to others around them, may have one or more negative effects, e.g., by reinforcing the notion that this person is different. In a school or educational environment, having a teacher wear highly visible protective clothing may reinforce to everybody in the classroom that one of the students is different and has special needs. Such reinforcement may undermine integration of the person with special needs within the educational environment, thereby further hindering that person's development. With similar effect, in the case of caregiving for Alzheimer's or dementia patients, highly visible protective clothing may reinforce the belief in these people that they are different or have lost some of their previous abilities, which may cause frustration that leads to further outbursts of anger.

Accordingly, embodiments of the invention(s) described herein provide a forearm protector and a protective garment each having a configuration that, when worn by a user, protects against injury from different forms of aggressive behavior such as impacts and/or abrasions. Such forearm protectors and protective garments configured according to the described invention(s) may each incorporate one or more protective panels that, when worn, cover parts of the body that may be susceptible to injury from aggressive behavior and which therefore may benefit from protection. For example, such protective panels may include one or more shock absorbing layers that are effective to mitigate injuries or other damage caused by impact force. In addition, one or more structural layers may provide shape to the protective panels as well as protecting against abrasions.

Configurations of such forearm protector(s) may provide a user with some degree of protection in a forearm area when worn. Additionally, such protective garment(s) may provide a user with some degree of protection, depending on how the protective garment(s) is/are configured, in one or more different areas of the torso and upper body, such as a stomach area, chest area, upper arm area, lower back area, and upper back area. In some cases, removable panels may be utilized so that the area(s) of protection are customizable according to the needs or desires of the user. In some cases, integrated panels may be utilized instead.

Such configured forearm protector(s) can also be worn, as either part of a kit or a protective system, together with such configured protective garment(s). Thus, in some cases, a forearm protector and protective garment may be worn in tandem and may cooperate to provide a greater area of protection that either protective article may provide individually. Thus, the configuration of the protective garment may be such that the forearm protector is accommodated by leaving gaps or voids, which the forearm protector may fill, in the area(s) covered by the protective garment alone. In other cases, a user may possess but elect not to use either the forearm protector or the protective garment depending on desire or need.

Whether a forearm protector is used by itself under non-protective clothing, or in tandem with a protective garment, in any case, the protective articles described herein may be such that a wearer can at least partially preserve the outward appearance of non-specialized clothing. Thus, a forearm protector may be worn by itself under non-protective clothing having a normal appearance or under a protective garment, as described herein, which also preserves some appearance of normal, non-protective clothing. Alternatively, depending on circumstances, such protective garment may also be worn without a forearm protector and still appear at least somewhat like normal, non-protective clothing.

Figure 1B:
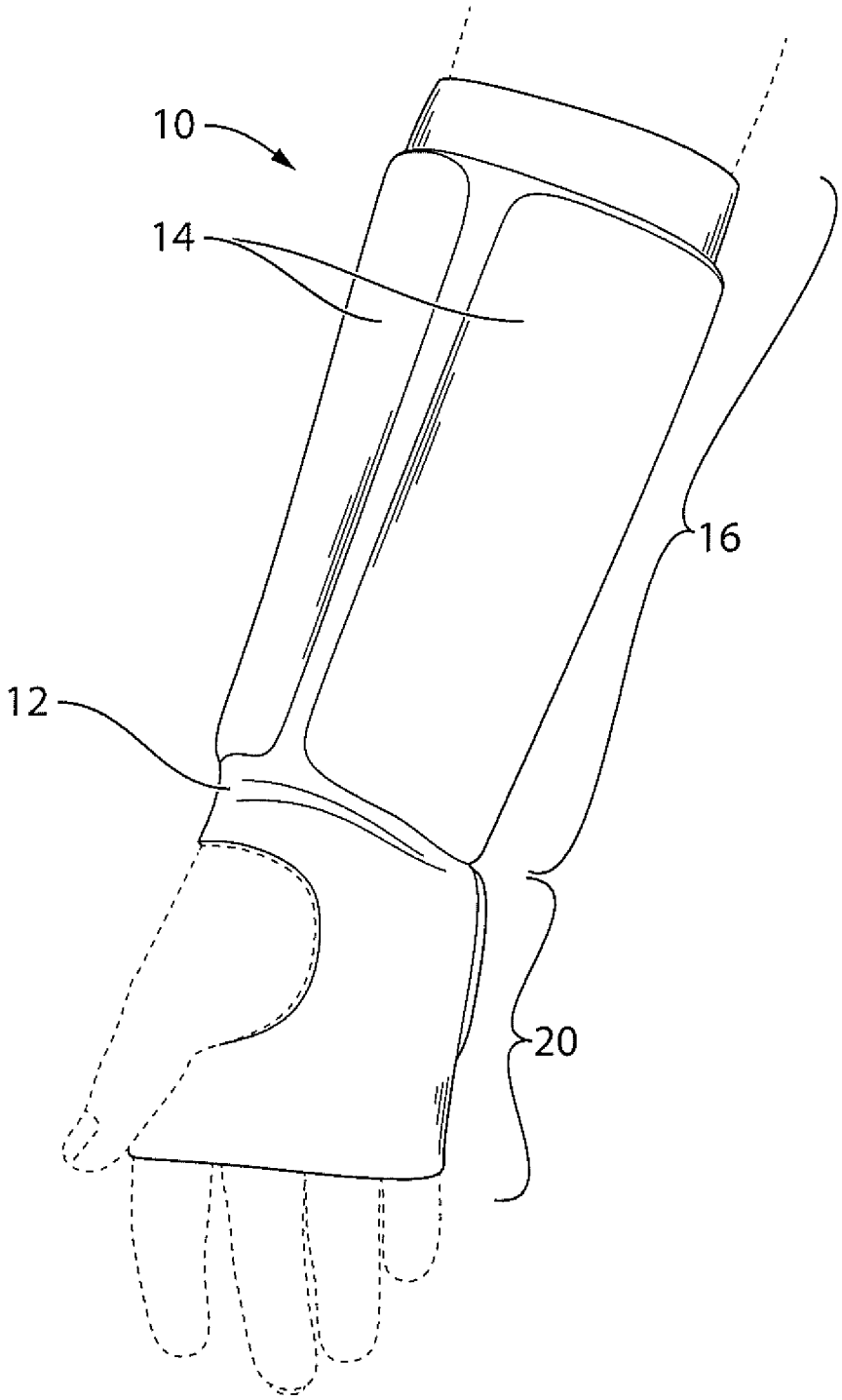
FIG. 1B shows another view of the forearm protector in FIG. 1A being worn by a user.

Reference is now made to FIGS. 1A and 1B, which show different views of an embodiment of a forearm protector 10 according to the disclosure. As seen, forearm protector 10 may comprise a fabric sleeve 12 which fits around the user's forearm and extends from a location at or around the user's hand (e.g., knuckles) to a location at or around the user's elbow, thereby to cover or substantially cover the user's forearm and at least part of the user's hand. The fabric used in sleeve 12 can be any suitable fabric, including both natural and/or synthetic fibers, whether woven or non-woven, which provides the user with a comfortable fit when worn. In some cases, the fabric used for sleeve 12 may be a breathable fabric. Elastics and other stretchable materials or fibers may also be incorporated in different embodiments to enhance user comfort while contributing to a secure fit around the arm.

Forearm protector 10 also includes a number, for example, one or more, integrated panels that provide a measure of protection to the wearer against various different forms of aggressive behavior. The integrated panel(s) may be formed out any suitable material or composite of materials so as to provide resistance to impacts and/or abrasions, while at the same time maintaining a generally slim profile or thickness. As mentioned, providing protection against various aggressive behaviors while maintaining for the user at least a resemblance to non-protective clothing are two aspects of the protective clothing described herein. Providing integrated panel(s) with a slim profile or thickness in forearm protector 10 may thereby contribute to the user's clothing retaining a normal, non-protective outward appearance.

In the embodiment of forearm protector 10 shown in FIGS. 1A and 1B, a total of four different panels are integrated into sleeve 12. For example, forearm protector 10 may include three separate panels 14 located in a forearm region 16 and an additional panel 18 located in a hand region 20 of forearm protector 10. In such arrangement(s), panels 14 may have a generally elongate shape extending from below the user's elbow to a location at or near to the user's wrist and be sized so as to provide completely or approximately complete circumferential protection of the user's arm and wrist. Thus, for example, each panel 14 may be arced so that, in the aggregate, the user's forearm is completely or approximately completely surrounded, e.g., surrounded except for space created by the seam(s) located between adjacent panels 14. In some cases, panels 14 may be approximately equally sized, e.g., approximately ⅓ of the circumference of the user's forearm, but in other cases the individual panels 14 may have different relative sizing (but still so that approximately fully coverage of the user's forearm is achieved).

Panel 18 located in hand region 20 may be spaced apart from panels 14 by a circumferentially running seam and sized so as to cover the top part of the user's hands between approximately the user's wrist and knuckles. Thus, for example, panel 18 may have a rectangular or approximately rectangular shape that, like panels 14, may contour to the user. The edges of panel 18 may be either straight or rounded and the corners between adjacent edges may be approximately right-angled or any other angle so that good contouring of the user's hand is achieved. Inclusion of a circumferential seam between panel 18 in the hand region 20 and the various panels 14 in the forearm region 16 (like the seams between adjacent panels 14) may add flexibility to forearm protector 10 when, e.g., so as to preserve a range of motion in the user's wrist while simultaneously protecting areas of the forearm, hand, and wrist that are susceptible to damage if struck or abraded.

Figure 6:
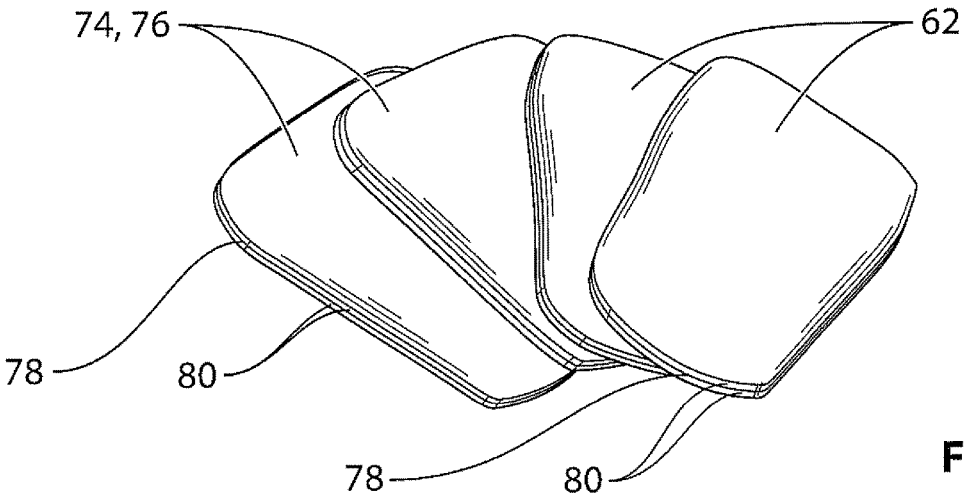
FIG. 6 shows a plurality of panels that may be removably incorporated into the protective garment shown in FIGS. 4 and 5.

In some embodiments, each panel 14 and 18 may have a composite structure comprising one or more layers of a suitable shock absorbing material together with one or more structural layers. For example, as seen in FIG. 6, each panel 14 and 18 may include one inner structural layer 78 sandwiched between two outer shock absorbing layers 80, although different numbers(s) and arrangement(s) of shock absorbing and structural layers 78, 80 may also be utilized. Suitable shock absorbing materials may include foams, gels, fibers, padding, and the like. Suitable structural layers 78 may include various different types and/or combinations of rigid or semi-rigid materials, including any or all of plastics, polymers, hard resins, carbon fiber, metals, and still others as the case may be. Thus, in some cases, each panel 14 and 18 may include a rigid plastic body layer 78 sandwiched between two outer foam layers 80.

To integrate panels 14 and 18 into sleeve 12, one or more different types or configurations of fastening mechanisms may be utilized. For example, a suitable bond layer or other chemical adhesive, such as glues, epoxies, resins, or other bonding agents, may be utilized. In other cases, sleeve 12 may be a composite including at least top and bottom layers that are integrated together so as to define one or more pockets into which the panels 14 and 18 may be accommodated. These are examples only.

Figure 2:
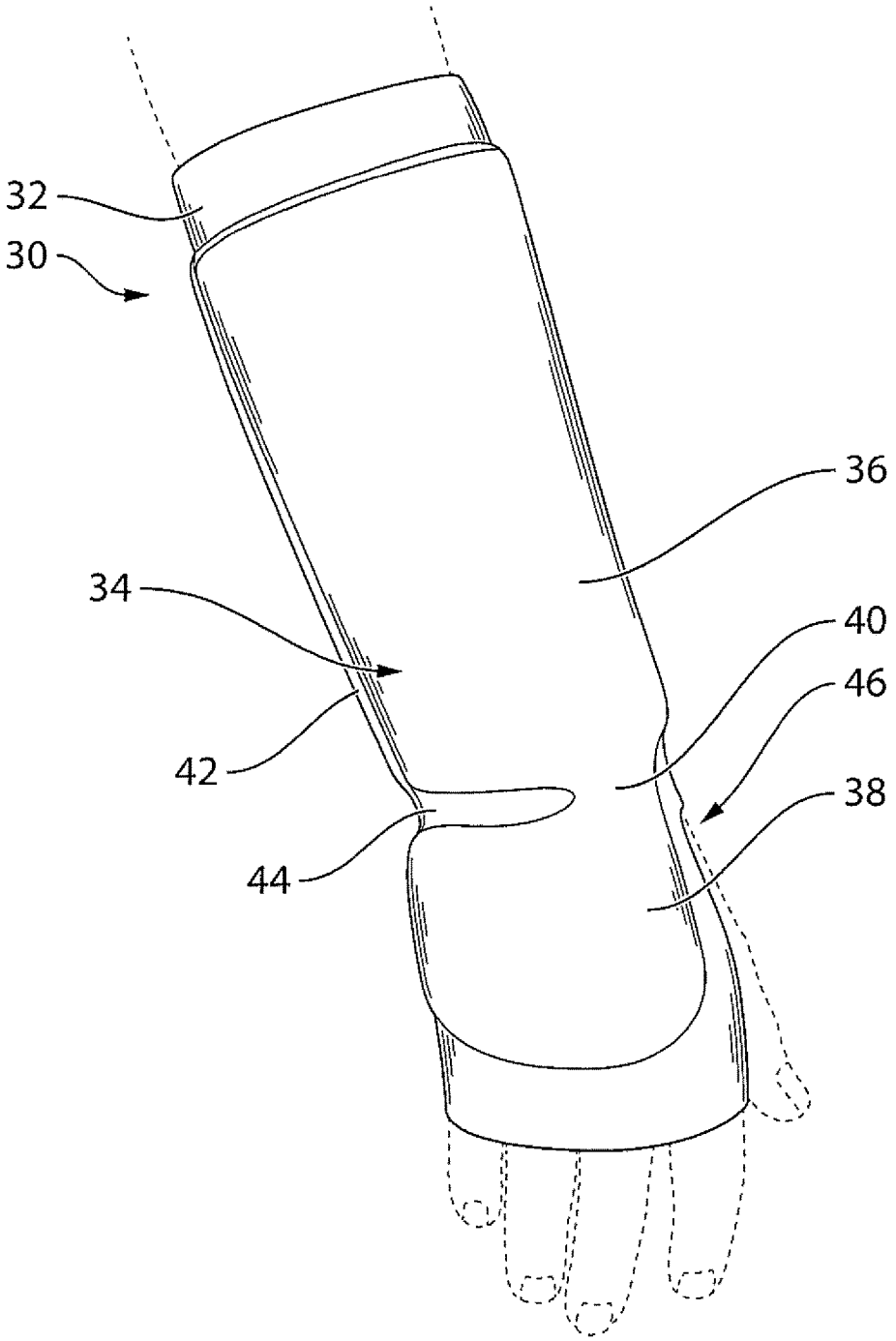
FIG. 2 shows an alternative embodiment of a forearm protector being worn by a user.

Referring now to FIG. 2, there is shown a configuration of a forearm protector 30 according to the disclosure. In some respects, forearm protector 30 may be the same or similar to forearm protector 10 shown in FIGS. 1A and 1B, while in other respects the two alternative configurations may differ. For clarity of explanation, certain of these differences may be highlighted, while description of aspects shared in common may be abbreviated. Thus, where silent, further description of forearm protector 30 may be found above with reference to FIGS. 1A and 1B.

Unlike forearm protector 10, the configuration of forearm protector 30 shown in FIG. 2 comprises only a single panel 34 integrated within a fabric sleeve 32. As seen, panel 34 may comprise one or more different shaped portions, all integrally formed within a single whole, which in the aggregate provide coverage of at least parts of the user's forearm, wrist, and hand. Thus, for example, panel 34 may comprise at least a forearm portion 36, a hand portion 38, and a wrist portion 40. While panel 34 has been divided up into these various portions, it will be understand that such labels may be, at least to some extent, arbitrary and presented for ease of explanation only without affecting the overall shape or configuration of panel 34.

Forearm portion 36 may have a generally elongate shape that wraps around or substantially around the user's forearm, from a location at or near to the user's elbow to a location at or near to the user's wrist, in so doing defining a seam 42, where no protection to the user is offered, formed between opposing edges of the forearm portion 36 which come close to one another but do not touch. In some embodiments, seam 42 defined by forearm portion 36 is aligned generally with the underside of the user's forearm as opposed to other locations on the top or side of the forearm. Thus, seam 42 may be located on an opposite side of forearm protector 30 to a thumbhole 46 (forearm protector 30 in FIG. 2, is being worn on the user's right hand).

In certain contexts, the location of seam 42 on the underside of the forearm tends to be naturally protected through normal, downward arm orientation. The underside of the forearm may therefore be the location which is less likely to suffer injury resulting from aggressive behavior and correspondingly less in need of the protection afforded by forearm portion 36. With its configuration that partially exposes the underside of the forearm, forearm protector 30 may be provide adequate or the appropriate degree of protection for these (or other) contexts.

However, there may also exist contexts in which it is not possible to always maintain a downward orientation and the underside of the forearm is, in fact, an area that is exposed to more significant risks of injury. For example, when tending to a person who is especially prone to violent outbursts, a caregiver or other person may often be required to raise their arms in a defensive posture, thereby exposing the underside of the forearm to the risk of harm. As explained further below, with reference to FIGS. 7A and 7B, alternative configurations of a forearm protector, which include a seam located in a different location of the forearm, may be utilized for these (or other) contexts.

Still referring to FIG. 2, in some embodiments, forearm portion 36 may transition integrally into wrist portion 40 by tapering in circumference in a location at or near to the user's wrist. Continuing in the same axial direction along the user's forearm away from the elbow, wrist portion 40 may then expand, again integrally, around and/or over top of the user's thumb, adjacent to thumbhole 46, into hand portion 38 that is shaped so as to cover or substantially cover the top of the user's hand between the wrist and the knuckles. Wrist portion 40 may thereby be generally aligned with the top side of the user's wrist overlying part of the user's thumb, or at least part of the user's wrist at or near to the base of the thumb, as this can also be a likely area for impact or abrasion.

So that the user may have sufficient flexibility and range of motion in the wrist area as would allow for the completion of ordinary, day-to-day tasks, such as manipulating mobile devices (smart phones, tablets, etc.), signing documents, turning door knobs, and the like, the shaping of forearm portion 36 and hand portion 40 can also be such that a circumferential seam 44 is defined therebetween. Seam 44 may run generally circumferentially between forearm portion 36 and hand portion 40, extending around the user's wrist from opposite sides of wrist portion 38. Tapering of forearm portion 36 (as seen in FIG. 2) may also cause the width of seam 44 to expand in a circumferential direction from the wrist portion 38 toward the seam 42 located on the underside of the forearm, which may generally work to increase flexibility in the wrist area and especially allow for palmarflexion and dorsiflexion of the hand.

In some embodiments, similar to panels 14 and 18 in forearm protector 10, panel 34 may be a composite panel that includes one or more shock absorbing layers 80 together one with or more structural layers 78. Also, as with panels 14 and 18, panel 34 may be integrated within sleeve 32 using any suitable fastening mechanism such as a bond layer or within a pocket formed between two material layers.

Figure 7A:
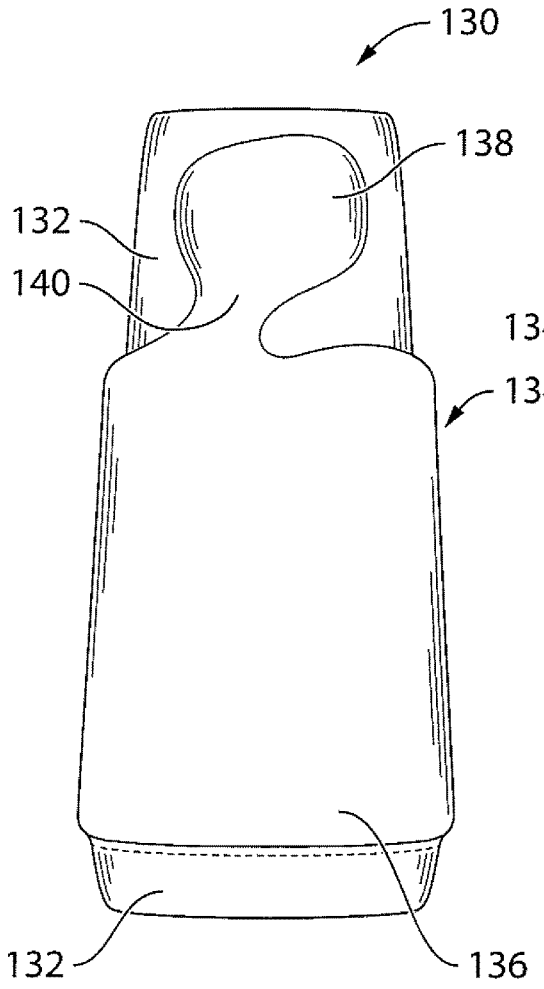
FIG. 7A shows a top view of another alternative embodiment of a forearm protector.
Figure 7B:
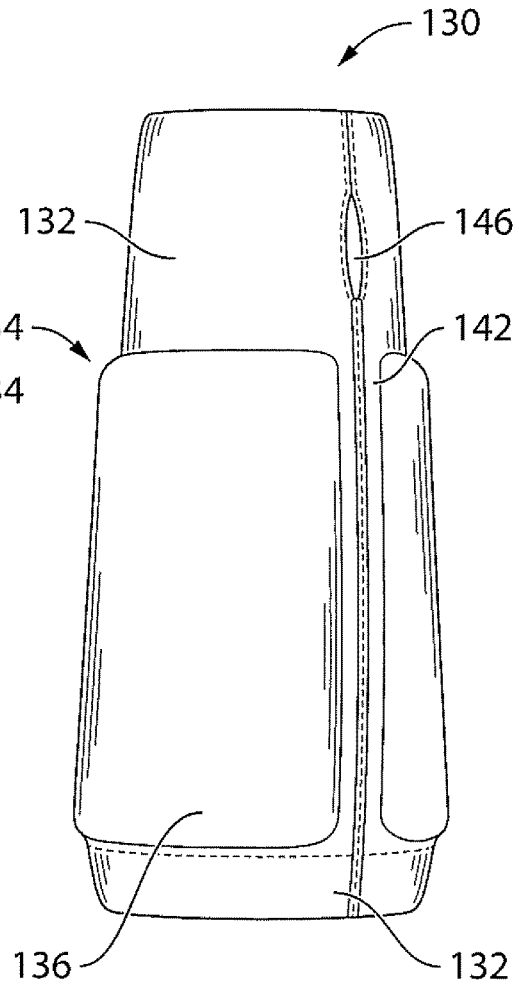
FIG. 7B shows a bottom view of the forearm protector shown in FIG. 7A.

Referring now to FIGS. 7A and 7B, there is shown top and bottom views of a forearm protector 130 according to the disclosure. Forearm protector 130 has a similar configuration to forearm protector 30 shown in FIG. 2, except for the location of a seam that is defined between adjacent edges of an integral integrated therein. In forearm protector 30, such seam is located generally on the underside of the user's forearm. Forearm protector 130 is otherwise shaped so that a seam is located generally on the top of the user's forearm. As noted, each configuration of a forearm may be advantageous or useful in different contexts or applications depending on the nature of the risk the user is seeking to protect against.

Accordingly, in some embodiments, forearm protector 130 may include a single panel 134 integrated within a fabric sleeve 132. Similar to panel 34, panel 134 may comprise one or more different shaped portions, all integrally formed within a single whole, which in the aggregate provide coverage of at least parts of the user's forearm, wrist, and hand. Panel 134 may again be a composite panel that includes one or more shock absorbing layers 80 together one with or more structural layers 78 as described herein. Additionally, panel 34 may in some embodiments be integrated within sleeve 132 using any suitable fastening mechanism such as a bond layer or within a pocket formed between two material layers.

Panel 134 may comprise a generally elongate forearm portion 136 that wraps around or substantially around the user's forearm, from a location at or near to the user's elbow to a location at or near to the user's wrist. As noted, a seam 142 may be formed between opposing edges of the forearm portion 136 which come close to one another but do not touch. Such seam 142, where no protection to the user is offered, in this case generally runs along the top the user's forearm. Thus, seam 142 may be generally aligned with a thumbhole 146 (the configuration shown in FIGS. 7A and 7B is therefore designed for the user's right hand and arm).

As with panel 34 in forearm protector 30, forearm portion 136 of panel 134 may transition integrally into wrist portion 140 by tapering in circumference in a location at or near to the user's wrist. Continuing in the same axial direction along the user's forearm away from the elbow, wrist portion 140 may then expand, again integrally, into a hand portion 138 that is shaped so as to cover or substantially cover the top of the user's hand between the wrist and the knuckles. To ensure flexibility and range of motion in the user's wrist area, a lateral width of wrist portion 140 may be small relative to the overall width of the user's hand, thereby accommodating movements such as palmarflexion and dorsiflexion of the hand. Also as can be shown, while hand portion may cover or substantially cover the top of the user's hand, in some cases, no padding can be provided on the reverse side of sleeve 132 (seen in FIG. 7B) in the hand area. This may facilitate gripping action and other finger manipulations, for example.

Figure 3:
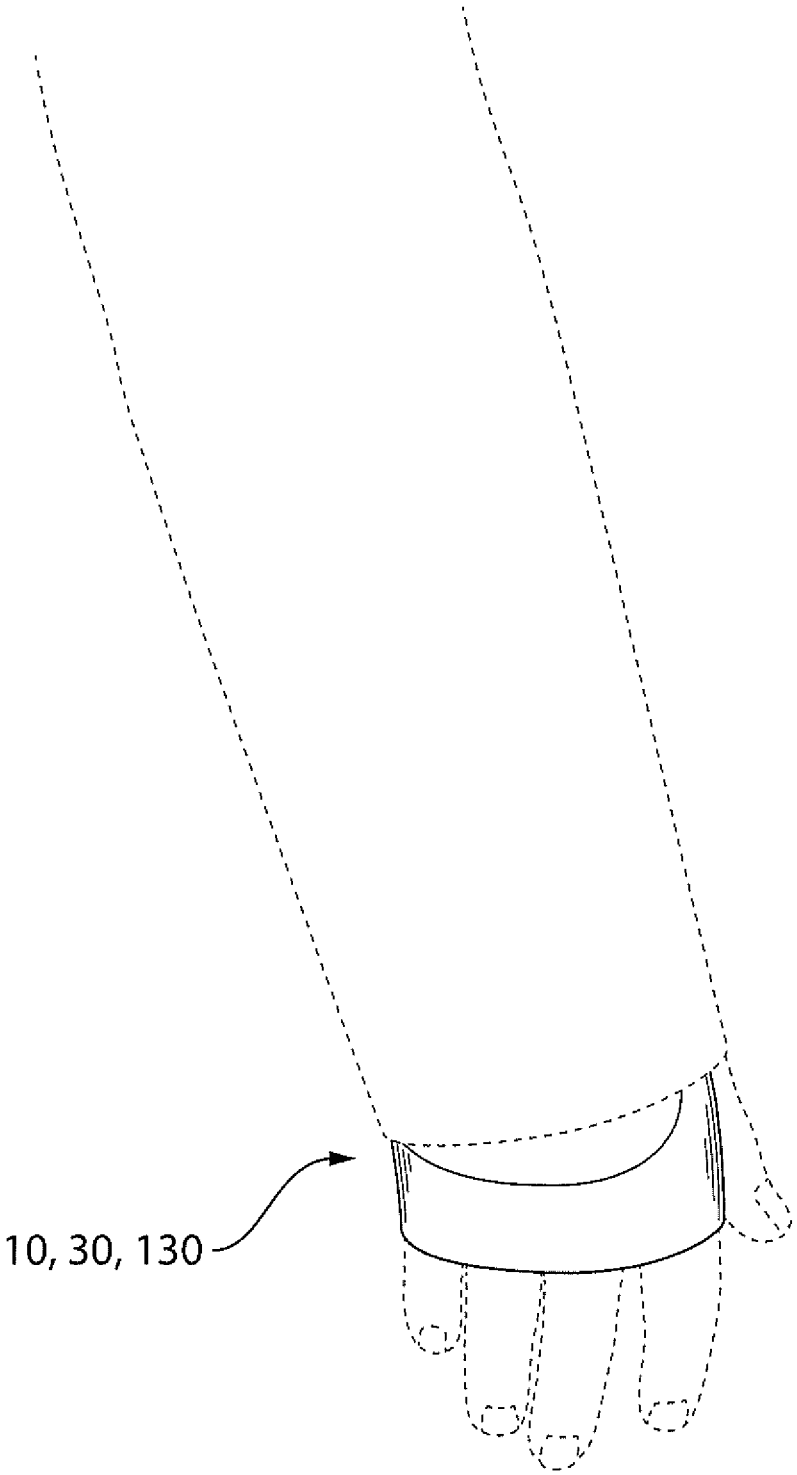
FIG. 3 shows an embodiment of a forearm protector, as in any of FIGS. 1A and 1B, FIG. 2, or FIGS. 7A and 7B, being worn by a user underneath a non-protective, long-sleeved garment.

Referring now to FIG. 3, there is shown a configuration of a forearm protector as described herein in use on a person. The user is wearing a long-sleeved shirt over top of any of forearm protector 10 (FIGS. 1A and 1B), forearm protector 30 (FIG. 2), or forearm protector 130 (FIGS. 7A and 7B). With the possible exception of in the hand area, where panel 18 (forearm protector 10), hand portion 38 of panel 34 (forearm protector 30), or hand portion 138 of panel 134 (forearm protector 130) is exposed and visible, forearm protector 10, 30, or 130 is substantially concealed beneath the user's long-sleeved shirt. In addition, because of the generally slim profile of the panel(s) included within forearm protector 10, 30, or 130 as described herein, the additional bulk introduced underneath the user's shirt is minimized or at least reduced, which tends to preserve the natural outward appearance of the shirt (as though it were being worn without a forearm protector 10, 30, 130 also being worn) to observers.

As mentioned, preserving the natural outward appearance to observers of the user's clothing, to the extent possible, despite the presence of a forearm protector 10, 30, or 130 may serve one or more different purposes or confer one or more different advantages. For example, where a forearm protector 10, 30, or 130 is being utilized to protect the user against potential impact or abrasion caused by a person with medical or developmental disabilities, such as autism or dementia, preserving the appearance of normalcy to the extent possible during provision of care may tend to facilitate integration of the person into various different environments.

Figure 4:
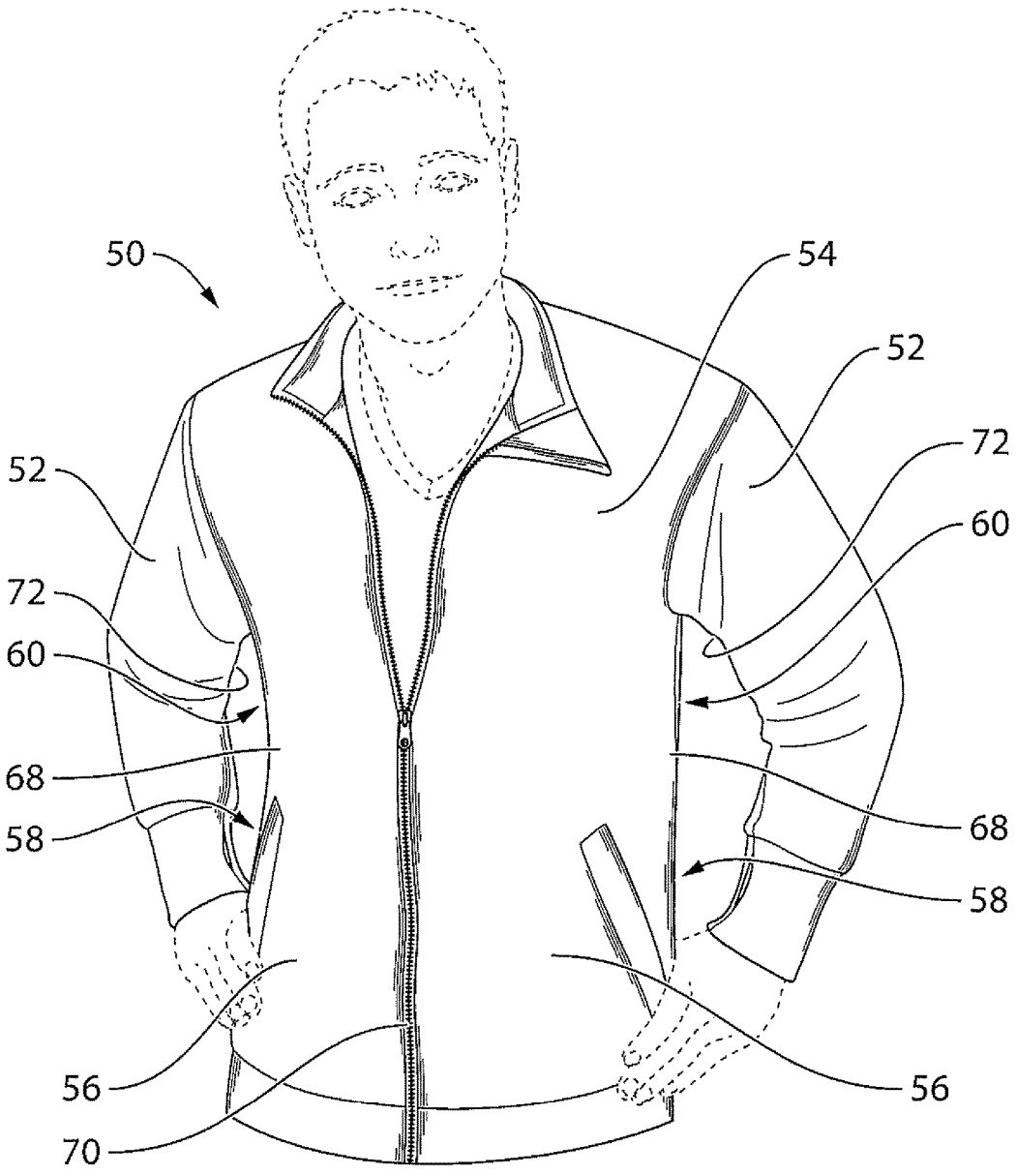
FIG. 4 shows an embodiment of a protective, long-sleeved garment being worn by a user.

Referring now to FIG. 4, there is shown a configuration of a protective garment 50 according to the disclosure. As shown, garment 50 is a long-sleeved garment shaped to be worm by a user and having an open front that may be fastened shut (herein referred to as "fastenable") using a zipper system or some other fastening system 70 that may be used in garments, such as buttons, snaps, Velcro™ or the like. Garment 50 may also include one or more exterior pockets (shown) for holding items or placing one's hands into, as well as an additional covering (not shown) for the user's head, such as a hood, which could either be detachable or else integrally formed with the rest of garment 50, as will be appreciated. Generally, garment 50 may be any outwardly worn, long-sleeved garment.

Garment 50 may also be provided with one or more protective panels, each one of a similar construction as panels 14 and 16 (forearm protector 10 shown in FIGS. 1A and 1B), panel 34 (forearm protector 30 shown in FIG. 2), or panel 134 (forearm protector 130 shown in FIGS. 7A and 7B). Such protective panel(s) may be provided at various different positions on or within garment 50 according to different configurations. For example, in some cases, the location of the panel(s) included in garment 50 may be those locations in which protection against aggressive behaviors such as impacts and abrasions may be desired. As will be described, the one or more panels provided in garment 50 may be either removable or integrated. For the purpose of the following description, terms like "removable" may be used to denote that a panel may easily be inserted into or extracted from garment 50 though manual processes without causing physical destruction of garment 50. Terms like "integrated" may be used to denote the opposite, i.e., that a panel is not easily removable using only manual processes or that removal would effectively require physical destruction of garment 50 to the point that it is no longer useful for one or more purposes.

Accordingly, in some embodiments, garment 50 may include one or more integrated panels in either or both of an upper arm area 52 and a chest area 54 located on either side (right and left) of a user. Thus, a panel may be integrated within each (right and left) upper arm area 52 and each (right and left) chest area 54 for a total of four integrated panels in these locations. As mentioned, each such integrated panel may have a composite construction comprising at least two shock absorbing layers 80 sandwiched around a structural layer 78, which may provide protection against impacts and abrasions while also defining a slim profile and having some built-in flexibility for comfort to the user while worn. Integration of panel(s) in the upper arm area 52 and/or chest area 54 may be effected using a mechanical bond layer or fastening in an internal pocket defined between two fabric layers of garment 50, as described above, or through some other alternative or equivalent mechanism generally without limitation.

In some embodiments, garment 50 may additionally be provided with one or more pockets in other locations throughout garment 50 for receiving removable panels therein. For example, one or more removable panel(s) may be received into corresponding pockets located in each of a stomach area 56, a lower back area 58, an upper back area 60, and in area(s) 68 on either or both sides (right and/or left) beneath the arm(s) of the user. Thus, for example, two panels (right and left) may be provided in any one, any two, or all of stomach area 56, lower back area(s) 58, upper back area(s) 60, and underarm area(s) 68, 72 for a total of, for example, four to eight removable panels in addition to any panel(s) that are integrated within garment 50. Thus for example, together with the integrated panel(s) in upper arm area 52 and chest area 54, anywhere between four and a total of twelve panels may be received into or carried by garment 50, depending on which removable panel(s) are or aren't included. However, the numbers and locations described herein are for illustration only and may vary in alternative embodiments.

As one specific example, a garment 50 accommodates a total of 5 removable panels, or inserts, into corresponding pockets located in the stomach area(s) 56 and back area(s) 58, 60. These may include two panels in the stomach area 56, two more in the lower back area 58, and an additional panel in the upper back area 60. This number and distribution of panels accommodates a fastening mechanism 70, such as zipper(s), button(s), snap(s), Velcro™, or some other attachment(s), at a front or other convenient location of the garment 50, so as to enable a user to easily don or remove the garment. In such an embodiment, this would provide a total of nine panels (taking into consideration four integrated panels as well) distributed throughout garment 50 at different areas in need of protecting.

Optionally, in other embodiments, garment 50 may be adapted to receive fixed or removable underarm inserts (see FIG. 6) also in either or both of underarm area(s) 68, 72. These panel(s) can be provided, for example, in corresponding pockets on each of the left and right upper, inside parts 72 of the arms, and/or in corresponding underarm (or side of chest) locations 68 on the body portion of the garment 50. Such inserts can, for example, provide effective protection for the underarm area(s) from pinches, etc., and therefore be included in garment 50 for use in situations where this particular form of protection would be beneficial.

As mentioned, panel(s) provided in any of stomach area 56, lower back area 58, underarm areas 68, 72, and/or upper back area 60 may be removable so as to be easily insertable and/or extractable from garment 50, thereby making it possible for a user to select which panel(s), if any, are to be included in garment 50 depending on the situation or desires of the user. In this way, the user may then customize garment 50 for various different situations by selecting areas of the body which are to be protected and other areas of the body which will not be protected. For example, one configuration may be suitable or desirable for one situation or environment, while a different configuration may then be suitable or desirable for a different situation or environment. By adding or subtracting removable panels, the user will be able to make use of a single garment 50 (after suitable customization) for all such situations. The user therefore can benefit from different levels of protection without having to carry or wear multiple different garments.

The number and/or location of integrated panels within garment 50 in relation to the number and/or location of removable panels may be based on or otherwise determined taking into consideration the protective needs of the wearer. Thus, it may be that there is a correlation between a perceived protective need and the type of panel provided (as there may also be correlation between perceived protective need and the location or existence of a panel). By taking into consideration perceived protective need, garment 50 may be configured in such fashion that a user is adequately protected for the situation(s) or environment(s) in which the garment 50 will be worn, while also preserving normal outward appearance and wearability to the extent possible.

Thus, in some cases, no panel, or a relatively lighter, thinner, or otherwise less-protective panel, may be provided within a garment 50 in areas where there is no perceived need, or a reduced need. At the same time, panel(s) of relatively heavier, thicker, or otherwise more-protective configuration(s) may be provided in areas where there is a greater perceived protective need. Of the areas in which there is a perceived protective need, moreover, it may be that an integrated panel is provided where the protective need is perceived to be great and/or constant (on the assumption that a user would not often be removing panels from these areas even if it were possible). Whereas for areas of lesser protective need or where the user may not consistently require protection, removable panels may be provided so that the user does in these cases have the option to either receive the benefit of the protection or to go without.

So for the example configuration shown in FIG. 4, it has been perceived that upper arm area 52 and chest area 54 are areas of generally high protective need for which the user will generally desire or benefit from protection. On the other hand, in the specific example shown in FIG. 4, stomach area 56, lower back area 58, underarm areas 68, 72, and upper back area 60 have been perceived to be areas of lesser protective need where having the option of protecting or not is beneficial to the user. Consequently, garment 50 has been configured for removable panels to be provided in these areas, therefore allowing the user to forego protection in any or all of these areas at his or her discretion. Of course, the configuration of garment 50 is but one possible configuration based on perceived protective need. Different configurations of a protective garment, having different number(s) and/or location(s) of integrated panels in relation to removable panels, may also be realized based on different perceptions of protective need.

Figure 5:
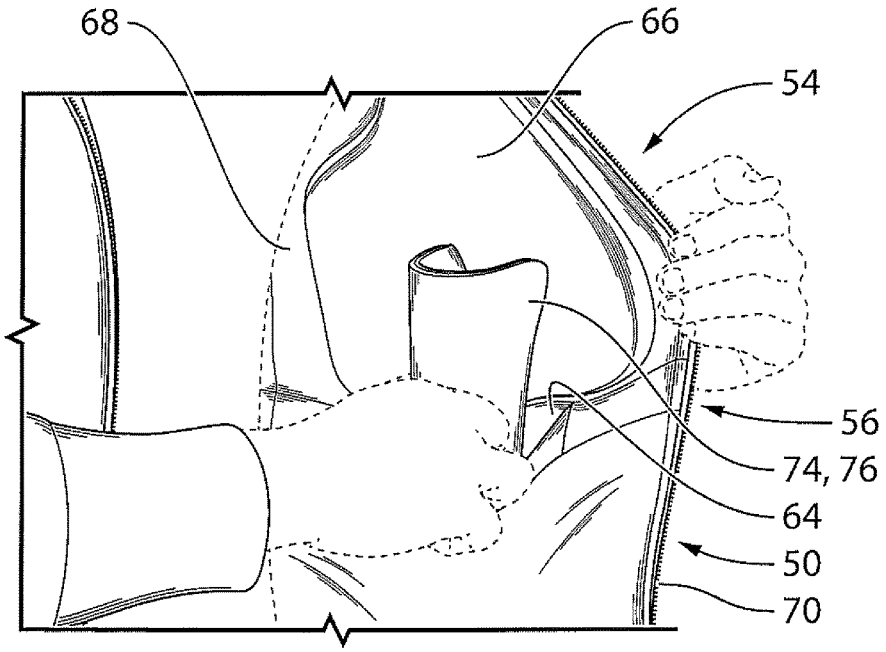
FIG. 5 shows a view of an interior, body-facing surface of the protective garment shown in FIG. 4.

Referring now to FIGS. 5 and 6, there are shown a view of the interior (i.e., body facing) surface of garment 50 and a plurality of removable panels 62, 74, 76 that may be releasably secured within garment 50 according to the disclosure. As shown in FIG. 5, a removable stomach-protection panel 76 is being inserted into (or extracted from) a pocket 64 defined in the interior surface of garment 50. The shape and size of the panels shown, in this example, are such that panel(s) 62 are intended for protecting right underarm areas 68, 72, while panel(s) 74, 76 are shaped to protect other areas of garment 50, such as stomach areas 56, lower back areas 58, and upper back areas 60. In some embodiments, stomach-protection panels 76 may also serve as back-protection panels 74. Alternatively, individually configured panels may be used for protection of stomachs, backs, and other user body portions. Of course, these are example only.

Pocket 64 is located in a left stomach area 56 of garment 50 and is shaped and sized so as to securely accommodate the dimensions of panel 76, e.g., so that panel 76 is held in or approximately in the same place within garment 50 and will not migrate or shift position when garment 50 is worn. While not shown explicitly, similar pockets may also be provided in a left stomach area 56, as well as in (right and left) lower back areas 58, (right and left) upper back areas 60, and left and right underarm areas 68, 72. Each such pocket may also be shaped and sized so as to accommodate the corresponding panel 62, 74, 76 (or other custom shape) that is designed to protect that area.

The outline of an integrated chest-protection panel 66 can also be seen in FIG. 5 in a left chest area 54 of garment 50. As mentioned, integrated panel 66 may be secured within an interior pocket defined between inner and outer fabric layers of garment 50 so as to be easily insertable and/or extractable therefrom, i.e., not without causing physical destruction of garment 50. Although not shown, similar integrated panels 66 may also be provided in a right chest area 54 and in (right and left) upper arm areas 52.

Accordingly, in some embodiments, removable panels 62 may be secured to garment 50 with use of pocket(s) defined in the interior (body-facing) surface of garment 50. However, a different securement mechanism may also be utilized. For example, in alternative embodiments, removable panels 62 may be secured using a non-permanent bond or joint such as a reusable adhesive layer. Mechanical fasteners, like snaps, buttons, hook-and-loop (i.e., VELCRO™) systems, or others may also be utilized in other embodiments.

In further embodiments, there is also provided a protection system comprising either or both of a protective garment 50 (as shown in FIGS. 4 and 5) and a forearm protector, such as any of forearm protector 10 (shown in FIGS. 1A and 1B), forearm protector 30 (shown in FIG. 2), or forearm protector 130 (shown in FIGS. 7A and 7B). Thus, for example, protective garment 50 may be provided with no protective panels (either integrated or removable) in a forearm area, so that one of the described forearm protectors 10, 30, 130 may be worn by the user underneath garment 50. As parts of a combined protective system, therefore, garment 50 may be configured so as to cooperate with a forearm protector 10, 30 or 130 in order to provide comprehensive protection of a person's arms and torso against aggressive behaviors like impacts and abrasions, with corresponding parts of the overall protection being provided by each component of the protective system. One or more protective panels or inserts, as described herein, may also be included in such a protective system for removable insertion into the protective garment in any desirable configuration.

Thus, as part of a combined protective system, different configurations conferring correspondingly different types and/or degrees of protection are possible. For example, a user may elect to wear only a forearm protector underneath a non-protective long-sleeved garment (as shown in FIG. 3). Such selection may be suitable where the user only desires forearm protection and either does not require or is otherwise willing to forego torso protection. Alternatively, a user could elect to forsake forearm protection and wear only a protective garment 50 configured with use of integrated or removable panels or inserts, as described herein, so as to protect whichever areas of the torso (stomach, chest, back, etc.) it is desired to protect. As a third option, a user could elect to wear protective garment 50 (again configured based on need or as desired) together with a forearm protector 10, 30, or 130. In this way, a combined protective system may be highly customizable based on need or desire so as to provide a multitude of different degrees of protection for a user.

The component elements of such a protective system may be acquired either individually or jointly by the user. Thus, in still further embodiments, there is also provided a kit comprising a protective garment 50 (as shown in FIGS. 4 and 5) and a forearm protector, such as any of forearm protector 10 (shown in FIGS. 1A and 1B), forearm protector 30 (shown in FIG. 2), or forearm protector 130 (shown in FIGS. 7A and 7B). As part of a kit, the user may then have the option of deploying any or each of a protective garment 50 or forearm protector 10, 30, 130 in any of the customizable configurations, as described herein, to suit the user's needs or wishes depending on the type and/or level of protection sought. Such kit may therefore also include one or more protective panels or inserts, as described herein, for removable insertion into the protective garment in any desirable configuration.

The above description is intended to provide a thorough description of various aspects and example embodiments of one or more inventions. Accordingly, various aspects and/or components of such invention(s) have been described throughout at multiple different levels of abstraction. In some instances, embodiments may have been described on both a specific and a relatively general or generic level, for example, where an aspect or component of the embodiment is susceptible to variation in a manner that is not inconsistent with the specific structure(s) and/or operation(s) set forth. In these instances, the specific embodiments set forth herein may not be the only ones contemplated and instead may only be exemplary of a more general or generic configuration. The scope of the invention(s) described herein is therefore defined solely by the language of the claims appended hereto, giving due consideration to applicable doctrines for construing their meaning.

The invention claimed is:

1. A protective system comprising:

a pair of forearm protectors, each of the forearm protectors securable to an arm of a user and comprising one or more onboard panels that provide the user's arm with protection against injury when worn;

a protective garment having forearm areas that are adapted to accommodate and substantially conceal the pair of forearm protectors therebeneath, the protective garment comprising at least one non-removable panel integrated within the body of the protective garment that provides the user with protection against injury in at least one body area not covered by the pair of forearm protectors, and wherein the protective garment further comprises one or more internal pockets; and one or more removable panels that are insertable into the one or more internal pockets of the protective garment, the one or more removable panels providing the user with protection against inquiry in at least one other body area not covered by either the pair of forearm protectors or the at least one non-removable panel;

wherein the at least one non-removable panel and, when inserted, the one or more removable panels are each substantially concealed within the body of the protective garment.

2. The protective system of claim 1, wherein the protective panels in each forearm protector have a slim profile and flexibility that facilitate concealment beneath the protective garment.

3. The protective system of claim 1, wherein each forearm protector comprises a sleeve into which the one or more onboard panels are integrated.

4. The protective system of claim 1, wherein the protective garment comprises a non-removable panel integrated within at least one of a chest area and an upper arm area of the protective garment.

5. The protective system of claim 1, wherein each at least one non-removable panel integrated within the protective garment has a slim profile and is flexible.

6. The protective system of claim 4, wherein the one or more internal pockets of the protective garment are located in at least one of an upper back area, a lower back area, a stomach area, and an underarm area of the protective garment.

7. The protective system of claim 1, wherein each at least one removable panel has a slim profile and is flexible.

8. The protective system of claim 1, wherein the protective panels in the pair of forearm protectors and each at least one non-removable panel integrated within the protective garment comprise one or more structural layers and one or more shock absorbing layers.

9. A kit comprising:

a pair of forearm protectors, each of the forearm protectors securable to an arm of a user and comprising one or more onboard panels that provide the user's arm with protection against injury when worn; and a protective garment having forearm areas that are adapted to accommodate and substantially conceal the pair of forearm protectors therebeneath, the protective garment comprising at least one non-removable panel integrated within the body of the protective garment that provides the user with protection against injury in at least one body area not covered by the pair of forearm protectors, and wherein the protective garment further comprises one or more internal pockets; and one or more removable panels that are insertable into the one or more internal pockets of the protective garment, the one or more removable panels providing the user with protection against inquiry in at least one other body area not covered by either the pair of forearm protectors or the at least one non-removable panel;

wherein the at least one non-removable panel and, when inserted, the one or more removable panels are each substantially concealed within the body of the protective garment.

10. The kit of claim 9, wherein the protective panels in each forearm protector have a slim profile and flexibility that facilitate concealment beneath the protective garment.

11. The kit of claim 9, wherein each forearm protector comprises a sleeve into which the one or more onboard panels are integrated.

12. The kit of claim 9, wherein the protective garment comprises a non-removable panel integrated within at least one of a chest area and an upper arm area of the protective garment.

13. The kit of claim 9, wherein each at least one non-removable panel integrated within the protective garment has a slim profile and is flexible.

14. The kit of claim 12, wherein the one or more internal pockets of the protective garment are located in at least one of an upper back area, a lower back area, a stomach area, and an underarm area of the protective garment.

15. The kit of claim 9, wherein each at least one removable panel has a slim profile and is flexible.

16. The kit of claim 9, wherein the protective panels in the pair of forearm protectors and each at least one non-removable panel integrated within the protective garment comprise one or more structural layers and one or more shock absorbing layers.

* * * * *